US006065536A

United States Patent [19]

Gudmestad et al.

[11] Patent Number: 6,065,536

[45] Date of Patent: May 23, 2000

[54] APPARATUS FOR SETTING A LINER IN A WELL CASING

[75] Inventors: Tarald Gudmestad, Hoyland; Arthur Hrman Dybevik; Ole Sveinung Kvernsteun, both of Sandnes, all of Norway

[73] Assignee: Weatherford/Lamb, Inc., Houston, Tex.

[21] Appl. No.: 09/077,166

[22] PCT Filed: Jan. 3, 1997

[86] PCT No.: PCT/GB97/00014

§ 371 Date: Sep. 14, 1998

§ 102(e) Date: Sep. 14, 1998

[87] PCT Pub. No.: WO97/25518

PCT Pub. Date: Jul. 17, 1997

[30] Foreign Application Priority Data

Jan. 4, 1996 [GB] United Kingdom ..... 9600103

[51] Int. Cl.[7] ..... E21B 23/10

[52] U.S. Cl. ..... 166/208; 166/212

[58] Field of Search ..... 166/208, 212, 166/120, 123, 125, 181, 382

[56] References Cited

U.S. PATENT DOCUMENTS

| | | | |
|---|---|---|---|
| 2,290,142 | 7/1942 | Burt | 166/122 |
| 2,315,931 | 4/1943 | Burt et al. | 166/122 |
| 2,409,811 | 10/1946 | Taylor, Jr. et al. | 166/193 X |
| 2,913,052 | 11/1959 | Harmon | 166/242 |
| 2,994,381 | 8/1961 | Brown | 166/224 |
| 3,223,170 | 12/1965 | Mott | 166/208 |
| 3,291,220 | 12/1966 | Mott | 166/208 |
| 3,776,307 | 12/1973 | Young | 166/125 |
| 3,845,819 | 11/1974 | Mourlevat | 166/239 |
| 3,934,652 | 1/1976 | Cochran | 166/285 |
| 3,942,833 | 3/1976 | Plunk | 294/86.18 |
| 4,047,565 | 9/1977 | Crickmer | 166/217 |
| 4,051,896 | 10/1977 | Amancharla et al. | 166/123 |
| 4,058,166 | 11/1977 | Crickmer | 166/315 |
| 4,096,913 | 6/1978 | Kenneday et al. | 166/290 |
| 4,249,601 | 2/1981 | White | 166/208 |
| 4,311,194 | 1/1982 | White | 166/120 |
| 4,712,614 | 12/1987 | Allwin et al. | 166/208 |
| 4,726,425 | 2/1988 | Smith, Jr. | 166/387 |
| 4,911,237 | 3/1990 | Melenyzer | 166/208 |
| 4,942,924 | 7/1990 | Duncan | 166/290 |
| 5,038,860 | 8/1991 | Baugh et al. | 166/208 |
| 5,311,941 | 5/1994 | Baugh | 166/208 |
| 5,318,131 | 6/1994 | Baker | 166/382 |
| 5,404,955 | 4/1995 | Echols, III et al. | 166/382 |
| 5,582,253 | 12/1996 | Fraser | 166/352 |
| 5,727,631 | 3/1998 | Baker et al. | 166/379 |
| 5,732,772 | 3/1998 | Borak, Jr. et al. | 166/75.14 |
| 5,735,344 | 4/1998 | Duncan | 166/75.14 |
| 5,857,524 | 1/1999 | Harris et al. | 166/382 |

*Primary Examiner*—William Neuder
*Assistant Examiner*—Chong S. Cho
*Attorney, Agent, or Firm*—Guy McClung

[57] ABSTRACT

A system for setting a liner in a well casing which has a liner, a liner hanger, a polished bore receptacle, a packer which can be actuated by applying downward pressure to the polished bore receptacle, a running tool, and a junk bonnet which extends between the polished bore receptacle and the running tool and inhibits the ingress of debris into the polished bore receptacle, the junk bonnet and the running tool provided with apparatus which, when the running tool is raised without removing the junket bonnet from the polished bore receptacle, the apparatus cooperate so that when the running tool is subsequently lowered downward force applied to the running tool will be applied to the polished bore receptacle to set the packer, wherein the apparatus comprises a lip which extends radially outwardly from the running tool, and a hook which is biased radially inwardly from the junk bonnet and including a ring which is disposed to restrict radial inward movement of the hook but which can be displaced by the lip to allow such movement.

10 Claims, 4 Drawing Sheets

20
3
45
19
21
22
43
44
46
50
38
49
48
47
35
32
27
24
31
27
28
II
II
SRM
51

APPARATUS FOR SETTING A LINER IN A WELL CASING

BACKGROUND OF THE INVENTION

1. Field of the Invention

This invention relates to an apparatus for setting a liner in a well casing.

2. Description of the Related Art Including Information Disclosed Under 37 CFR 1.97 & 1.98

During the construction of oil and gas wells a wellbore is drilled in the ground. After a certain depth is reached drilling is halted and a well casing lowered down the wellbore and cemented in place. Drilling is then recommenced until the wellbore reaches the next predetermined depth. At this stage drilling is halted and a liner lowered down the well casing. The liner is suspended from the well casing by a device known as a liner hanger which acts between the liner and the well casing.

The liner hanger can be set mechanically or hydraulically. U.S. Pat. No. 3,291,220 shows an apparatus for setting a liner in a well casing, which apparatus comprises a liner hanger and a running tool. The running tool is provided with a valve seat obstruction of which will, in use, allow fluid pressure to be developed to set the liner hanger in the well casing. Once the liner hanger has been set the running tool is rotated anti clockwise to unscrew the running tool from the liner hanger. The running tool is then recovered.

BRIEF SUMMARY OF THE INVENTION

The present invention is characterised in that after the liner hanger has been set the application of further pressure will displace the valve seat to enable the running tool to be released and to allow fluid flow through the running tool.

Preferably, the liner hanger comprises a plurality of slips which are mounted on a ring which is restrained against motion by a shear member.

Advantageously, the liner hanger is provided with a packer and a member which, in use, applies pressure to the packer to deform it to occupy the space between said liner hanger and the well casing.

Preferably, the apparatus includes a plurality of slips, at least one of which is attached to the member by a shear member, the arrangement being such that when pressure is applied to the member via the slips the packer deforms to occupy the space between the liner hanger and the well casing, and subsequently the shear member fails so that the slips move into a position between the member and the well casing to retain the packer in its deformed position.

Advantageously, the slips form part of a polished bore receptacle.

Preferably, the running tool comprises a liner support unit which comprises a body, a unit which extends outwardly from the body and engages one of the liner and the liner hanger, and wherein the valve seat is disposed in the liner support unit and is releasably attached thereto by a shear member.

Advantageously, the apparatus includes at least one member which acts between the valve seat and the unit to maintain the unit in the extended position.

Preferably, the liner support unit comprises the body, a support which is fast with or integral with the body, and a ring which is slidably mounted on the body, rests on the support, and accommodates the unit, the arrangement being such that when the unit is in its extended position the body and the support can be moved relative to the ring and the unit accommodated thereby to a secondary release position in which the unit can move radially inwardly.

Advantageously, the body is provided with a recess to accommodate the unit when the body is in the secondary release position.

Preferably, the running tool is provided with a lug which rests on the liner hanger, and the liner hanger is provided with a slot which, when the lug is moved into alignment with the slot allows the running tool to be moved relative to the liner hanger and the liner support unit to be moved to its secondary release position.

Normally the liner is provided with both a liner hanger and a polished bore receptacle which extends upwardly from the liner hanger and is fitted with a junk bonnet which acts between the polished bore receptacle and the running tool to inhibit debris, for example cement, coming into contact with the many parts of the running tool whose operation could be inhibited or prevented by the ingress of debris.

Previously, after the liner has been set and cemented in position the final step has been to raise the running tool to an extent such that the junk basket is removed from the top of the polished bore receptacle. At this stage spring loaded lugs move outwardly from part of the running tool so that when the running tool is subsequently lowered the lugs bear on the polished bore receptacle which actuates the packer between the liner and the well casing. During this time debris is free to enter the tool and the polished bore receptacle which is undesirable both because of the prolonged exposure of the running tool to debris and the fact that debris can accumulate in the details of the liner hanger and polished bore receptacle impairing re-entry of the running tool should this be required.

According to another aspect of the present invention there is provided an apparatus for setting a liner in a well casing, which apparatus comprises a liner, a liner hanger, a polished bore receptacle, a packer which can be actuated by applying downward pressure to said polished bore receptacle, a running tool, and a junk bonnet which extends between said polished bore receptacle and said running tool and inhibits the ingress of debris into said polished bore receptacle, characterised in that said junk bonnet and said running tool are provided with means which, when said running tool is raised sufficiently, without removing said junk bonnet from said polished bore receptacle, co-operate so that if said running tool is subsequently lowered downward force applied to said running tool will be applied to said polished bore receptacle to set said packer.

Preferably, said means comprises a lip which extends radially outwardly from said running tool, and a hook which is biased radially inwardly from said junk bonnet.

Advantageously, said apparatus includes a ring which is disposed to restrict radial inward movement of said hook but which can be displaced by said lip to allow such movement.

Preferably, the junk bonnet comprises a unit which extends outwardly therefrom and engages the polished bore receptacle to inhibit separation thereof, and the unit is maintained in the extended position by a ring which is displaceable to enable said unit to move out of engagement with the polished bore receptacle.

BRIEF DESCRIPTION OF THE SEVERAL VIEWS OF THE DRAWINGS

For a better understanding of the present invention reference will now be made, by way of example, to the accompanying drawings, in which.

DETAILED DESCRIPTION OF THE INVENTION

Figure 1A:
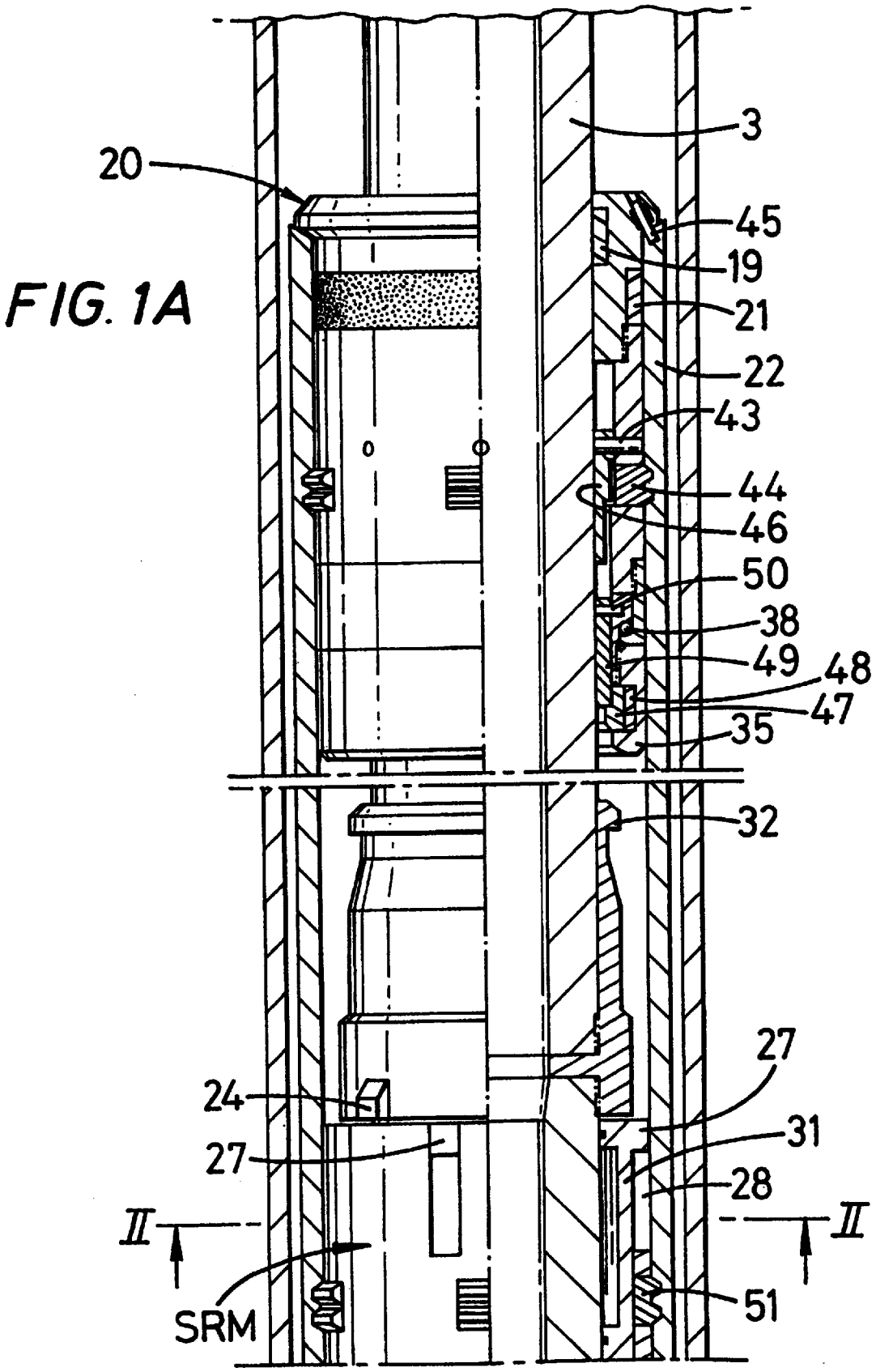
FIGS. 1A, 1B and 1C together show a side view, partly in cross-section, of an apparatus in accordance with the present invention in use.
Figure 1B:
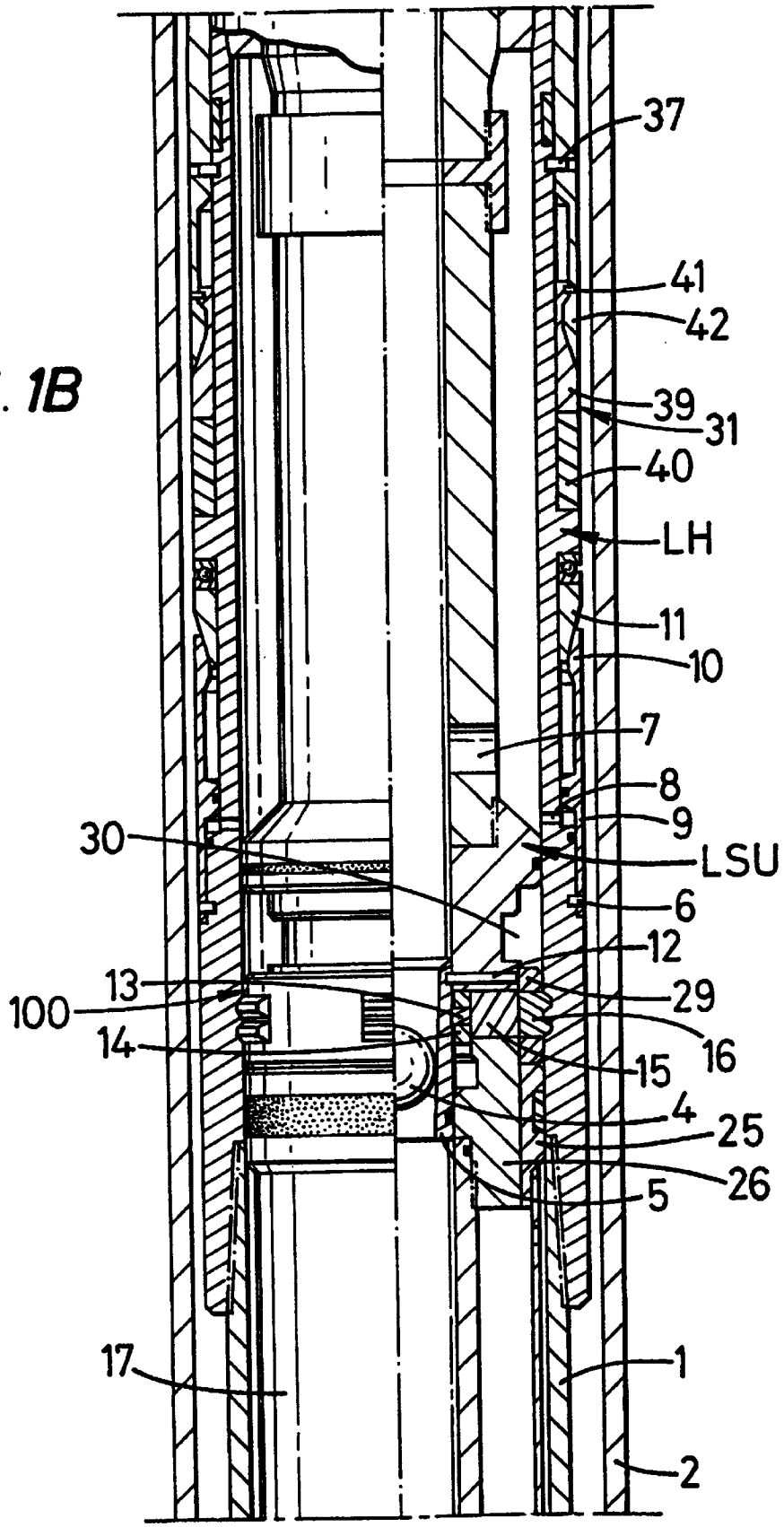
Figure 1C:
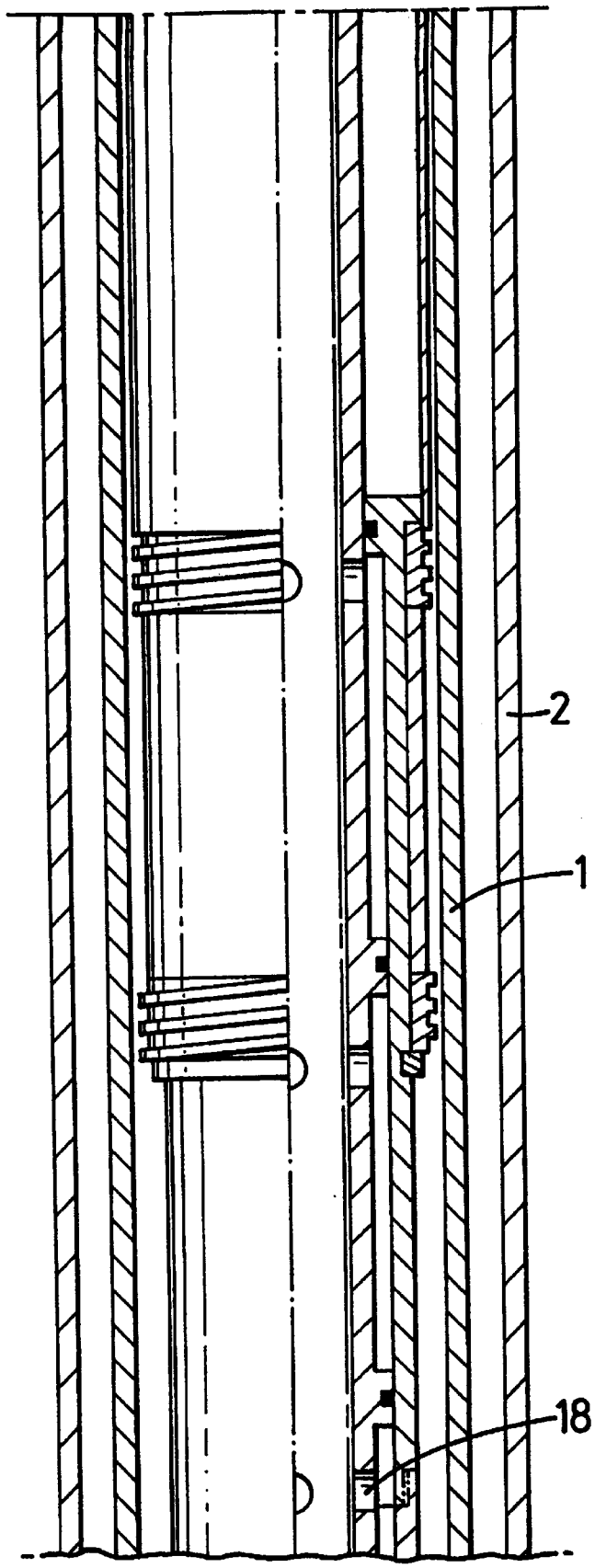

Referring to FIGS. 1A, 1B and 1C of the drawings there is shown a liner 1 which is suspended within a well casing 2 by a running tool 100 which is attached to the bottom of a drill string (not shown).

The top of the liner 1 is attached to a liner hanger which is generally identified by reference LH. A polished bore receptacle 22 extends upwardly from the top of the liner hanger (LH).

The running tool 100 comprises an upper tubular member 3 and a lower tubular member 17 which are connected by a liner support unit (LSU) which is provided with a plurality of teeth units 16 which extend radially outwardly into grooves in the liner hanger LH and releasably connect the liner hanger LH to the running tool 100.

The teeth units 16 are maintained in position by dogs 15 which are themselves maintained in position by dog keepers 13 and 14 which are in turn maintained in position by a valve seat 5 which is held in the liner support unit LSU by a shear pin 12. The liner support unit LSU comprises a body 26 having a support 25 fast thereon. Ring 29 which accommodates the teeth units 16 is a push fit on the body 26.

In operation the liner 1 is lowered on the running tool 100. The weight of the liner 1 is supported by the liner hanger (LH) which bears on the teeth units 16 which are supported by the support 25 fast with the body 26. During this operation it is not uncommon for the liner 1 to become blocked by an obstruction. A common method of removing such obstructions is to pump fluid, typically drilling fluid, down through the liner 1 until the obstruction is removed whereafter the liner 1 can be further lowered.

When the liner 1 reaches the required position a ball 4 is released into the drill string. The ball 4 passes through the drill string and the upper tubular member 3 of the running tool 100 and comes to rest on the valve seat 5.

Fluid is then pumped down the drill string. Since the passage of fluid is blocked by the ball 4 the pressure is transmitted through holes 7 and 8 and acts on ring 9 which is restrained by shear pin 6.

When the pressure of the fluid reaches about 103 bar (1500 psi) the shear pin 6 fails which enables ring 9 to move upwardly. The ring 9 is provided with a plurality of separate and distinct slips 10 which, as the ring 9 moves upwardly, are forced outwardly by the tapered surface on a ring 11 until they engage the well casing 2.

Once the slips 10 have moved to their outermost position the fluid pressure is again increased until at about 172 bar (2500 psi) the shear pin 12 fails. The ball 4 and valve seat 5 travel down the lower tubular member 17 until they land on the floor thereof (not shown) below port 18. As the valve seat 5 moves downwardly the dog keepers 13 and 14 are no longer restrained nor are the dogs 15 or the teeth units 16.

Accordingly, when an upward force is applied to the running tool 100 the teeth units 16 should (if they have not already done so) move radially inwardly to allow the running tool 100 to be raised.

It will be noted that the release of the valve seat 5 permits separation of the running tool 100 from the liner 1. Furthermore, fluid flow through the running tool 100 is now re-enabled with the fluid leaving the running tool 100 via outlets including outlet 18 disposed along the length of the lower tubular member 17.

Should the liner 1 fail to separate from the running tool 100 in the manner described, for example by failure of the shear pin 12 to fracture or the valve seat 5 jamming, the running tool 100 includes a secondary release mechanism which is generally identified by reference SRM.

The secondary release mechanism (SRM) comprises three lugs 24 which project radially from a boss fast with the upper tubular member 3 of the running tool 100. In its normal position the lugs 24 overlie the top of the liner hanger (LH) and consequently prevent the running tool 100 being lowered beyond the position shown with respect to the liner hanger (LH). (In this connection the lug 24 has been illustrated displaced slightly anti-clockwise of its normal position to facilitate understanding of its operation.)

However, if the tool string is rotated anti-clockwise the lugs 24 come into alignment with longitudinally extending slots 28 in the liner hanger (LH). When this occurs the running tool 100 can be lowered sufficient to displace the body 25 of the liner support unit (LSU) (together with the support 25, ring 29, dogs 15, dog keepers 13, 14, valve seat 5, ball 4 and shear pin 12) downwards sufficient to bring the teeth units 16 into alignment with a recess 30 in the body 26 of the liner support unit LSU and thus allow the teeth 16 to move into the recess 30 and release the liner 1 from the running tool 100. It should perhaps be emphasised that the support 25 is fast with the body 26 of the liner support unit LSU whereas the ring 29 merely fits snugly over the body 16 but can be removed therefrom with the application of only a light force.

Figure 2:
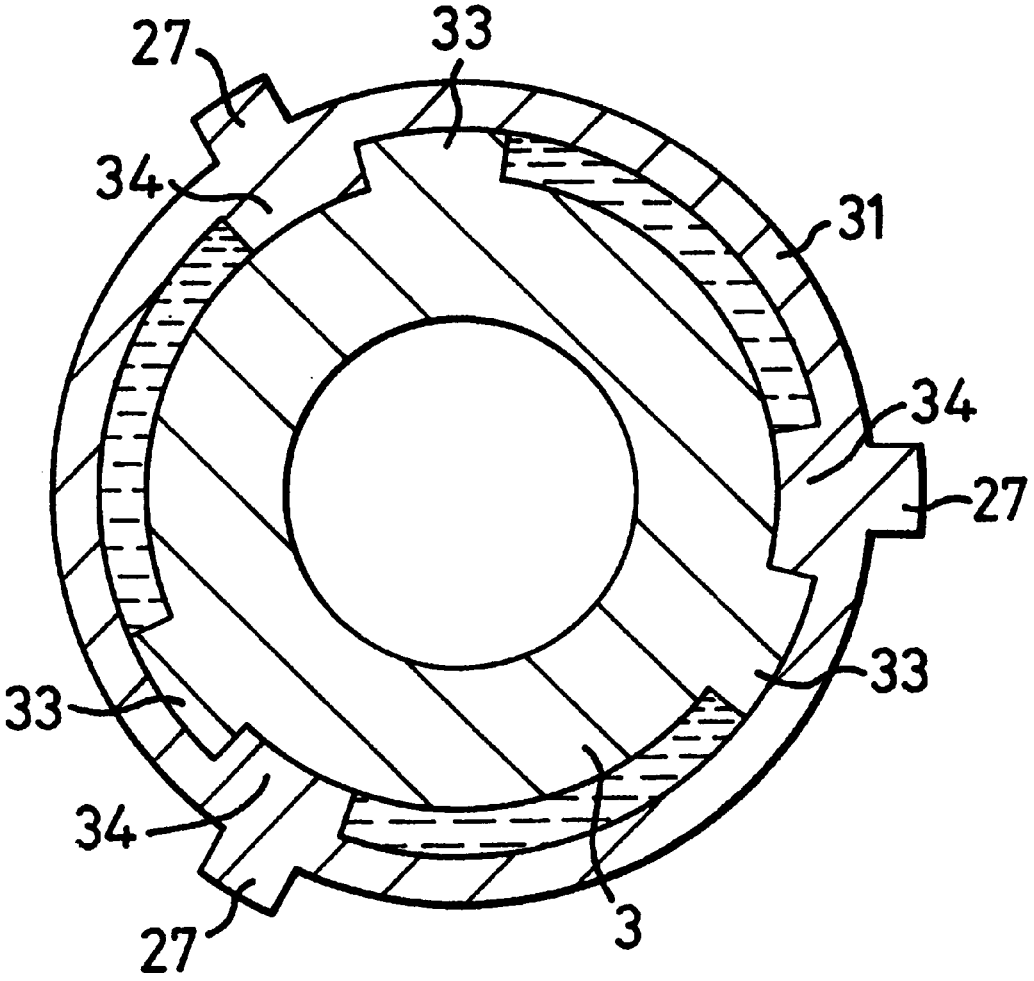
FIG. 2 is a section taken on line II—II of FIG. 1 with parts omitted for clarity.

It will be appreciated that great care must be taken to ensure that the secondary release mechanism (SRM) does not operate inadvertently and accordingly the secondary release mechanism (SRM) includes a damper so that the lugs 24 can only come into alignment with the slots 28 if a sufficient anti-clockwise force, for example 3500 ft·lbs of left-hand torque, is applied to the drill string for a sufficient time, for example 30 seconds. In order to achieve this the secondary release mechanism (SRM) incorporates a damper unit which is better shown in FIG. 2. In particular, the damper unit comprises a rotor which forms part of the upper tubular member 3 of the running tool 100 and a stator 31 which is provided with three lugs 27 which project into the slots 28.

The rotor is provided with three radially outwardly extending vanes 33 whilst the stator 31 is provided with three radially inwardly extending vanes 34. The spaces between the vanes are filled with grease 36. In use, when an anti-clockwise force is applied to the running tool 100 the rotor attempts to move anti-clockwise. However, this movement is resisted by the grease which slowly oozes past the minute clearance between the radial extremities of the vanes 33 and the inside of the stator 31. This delays the lugs 24 coming into alignment with the slots 28 unless a sufficient anti-clockwise force is applied for a sufficient time. When a clockwise force is applied, as in normal operation, the stator 35 moves to the position shown in FIG. 2 where the vanes 33 abut the vanes 34. In this position clockwise rotation of the drill string is transmitted to the liner hanger LH via the lugs 27 and the slots 28.

Such rotation can be extremely helpful for facilitating the running of the liner 1 and during the subsequent cementation operation. In this connection, it will be noted that the liner hanger (LH) is provided with a bearing above the ring 11 to facilitate rotation of the liner 1 after the liner hanger (LH) has been set.

Historically, the practice at this stage would have been to completely withdraw the running tool 100 and then cement the liner 1 in position. However, the practice now is to raise the running tool 100 by a small distance to confirm that the liner 1 has been separated from the running tool 100 and then proceed with cementing through the drill string and running tool 100.

With this in mind, the top of the polished bore receptacle 22 is provided with a junk bonnet 20 which is intended to prevent material entering the polished bore receptacle 22 particularly during the cementing operation.

The junk bonnet 20 comprises a seal 19 which slidably engages the outer wall of the upper tubular member 3 and a seal 21 which engages the inner wall of the polished bore receptacle 22. The junk bonnet 20 is maintained in the polished bore receptacle 22 by teeth units 44 which project into grooves in the polished bore receptacle 22. The junk bonnet 20 is also restrained from rotation by a spring loaded pin 45 which is mounted in the junk bonnet 20 and which projects into a recess in the top of the polished bore receptacle 22 as shown.

The teeth units 44 are maintained in the radially extended position shown by a ring 46 which is held in place by a shear pin 43.

The bottom of the junk bonnet 20 is provided with an inwardly extending flange 35 which supports a plurality of hooks 47 which are biased radially inwardly by a resilient pad 48 but are restrained by a ring 49 secured to the junk bonnet 20 by a shear pin 50. The upper end of the hooks 47 rest on a bearing race 38 as shown.

In operation after the liner hanger LH has been set and the running tool 100 disconnected the running tool 100 is raised a short distance to confirm that disconnection has occurred. The running tool 100 is then lowered to relocate the lugs 27 in the slots 28.

Cementing then proceeds. This involves pumping cement down the drill string, through the running tool 100 and down the liner 1. The cement is supplied under pressure and consequently is squeezed up through the annular space between the liner 1 and the wellbore until it reaches the bottom of the well casing 2 when it passes up through the annular gap between the liner 1 and the well casing 2. During this time the liner 1 is rotated to enhance the distribution and compaction of the cement. Eventually the cement rises up between the liner 1 and the well casing 2 and a thin layer of cement covers the top of the junk bonnet 20.

At this time the running tool 100 is raised until the lip 32 enters the bottom of the junk bonnet 20. The lip 32 displaces the hooks 47 radially outwardly and then bears upwardly on the ring 49 until the shear pin 50 fails. As the ring 49 is pushed further up inside the junk bonnet 20 the hooks 47 move radially inwardly so that when the running tool 100 is lowered the lip 32 is supported on the hooks 47.

Downward force (typically 6800 kg (15,000 lbs)) is applied to the running tool 100. This force is applied to the junk bonnet 20 via the lip 32 and is transmitted to the polished bore receptacle 22.

It will be noted that when the running tool 100 was raised the stator 31 of the secondary release mechanism (SRM) also moved upwardly leaving the teeth units 51 connecting the polished bore receptacle 22 to the liner hanger LH unsupported. If the teeth units 51 have not already done so the application of downward force to the polished bore receptacle 22 displaces the teeth unit 51 inwardly and also shears sheet pin 37. As the polished bore receptacle 22 moves downwardly the packer 40 is squeezed downwardly and deformed outwardly against the well casing 2 by the core member 39. Further downward pressure (typically 18,200 kg (40,000 lbs)) fractures shear pin 41 causing the slip 42 to move outwardly over the cone member 39 and lock the packer 40 in position.

The running tool 100 is now raised so that the lip 32 bears against the ring 49 which in turn bears against the ring 46 until the shear pin 43 fails after which the teeth unit 44 can enter the recess in the ring 49 and the entire running tool 100 can be raised to the surface together with the valve seat 5, ball 4, teeth units 16 and any other debris which will have collected on the floor of the lower tubular member 17 below the port 18.

If it is not possible to fracture the shear pin 43 by a straight pull this may be accomplished by a combination of rotating the drill string and pulling. The spring loaded pin 45 facilitates this operation by preventing the junk bonnet 20 rotating in concert with the upper tubular member 3.

At the completion of the operation only the well casing 2, the liner 1, the liner hanger (LH), its components and the polished bore receptacle 22 should remain in the wellbore.

By way of background, it should be noted that the packer 40 is set to ensure fluid tightness between the liner 1 and the well casing 2 even though there is cement between these components It should also be noted that not all liners are cemented in place in which case the packer 40 is set immediately after the liner hanger (LH) has been set and the running tool 100 separated from the liner hanger (LH).

We claim:

1. An apparatus for setting a liner in a well casing, which apparatus comprises a liner (1), a liner hanger (LH), a polished bore receptacle (22), a packer (40) which can be actuated by applying downward pressure to said polished bore receptacle (22), a running tool (100), and a junk bonnet (20) which extends between said polished bore receptacle (22) and said running tool (100) and inhibits the ingress of debris into said polished bore receptacle (22), characterised in that said junk bonnet (20) and said running tool (100) are provided with means (47, 32) which, when said running tool (100) is raised without removing said junk bonnet (20) from said polished bore receptacle (22), said means cooperate so that when said running tool (100) is subsequently lowered downward force applied to said running tool (100) will be applied to said polished bore receptacle (22) to set said packer (40), wherein said means (47, 32) comprises a lip (32) which extends radially outwardly from said running tool (100), and a hook (47) which is biased radially inwardly from said junk bonnet (20), and a ring (49) which is disposed to restrict radial inward movement of said hook (47) but which can be displaced by said lip (32) to allow such movement.

2. An apparatus for setting a liner in a well casing, which apparatus comprises a liner (1), a liner hanger (LH), a polished bore receptacle (22), a packer (40) which can be actuated by applying downward pressure to said polished bore receptacle (22), a running tool (100), and a junk bonnet (20) which extends between said polished bore receptacle (22) and said running tool (100) and inhibits the ingress of debris into said polished bore receptacle (22), characterised in that said junk bonnet (20) and said running tool (100) are provided with means (47, 32) which, when said running tool (100) is raised without removing said junk bonnet (20) from said polished bore receptacle (22), said means cooperate so that when said running tool (100) is subsequently lowered downward force applied to said running tool (100) will be applied to said polished bore receptacle (22) to set said packer (40), wherein said junk bonnet (20) comprises a unit (44) which extends outwardly therefrom and engages said polished bore receptacle (22) to inhibit separation thereof, and wherein said unit (44) is maintained in said extended position by a ring (46) which is displaceable to enable said unit (44) to move out of engagement with said polished bore receptacle (22).

3. An apparatus for setting a liner (1) in a casing (2), which apparatus comprises a liner hanger (LH) and a running tool (100), wherein said running tool (100) is provided with a valve seat (5) obstruction of which will, in use, allow fluid pressure to be developed to set said liner hanger (LH) in said well casing (2), characterised in that after said liner hanger (LH) has been set the application of further pressure will displace said valve seat (5) to enable said running tool (100) to be released and to allow fluid flow through said running tool (100), wherein said liner hanger (LH) is provided with a packer (40) and a member (39) which, in use, applies pressure to said packer (40) to deform it to occupy the space between said liner hanger (LH) and said well casing (2), a plurality of slips (42), at least one of which is attached to said member (39) by a shear member (41), the arrangement being such that when pressure is applied to said member (39) via said slips (42) said packer (40) deforms to occupy the space between said liner hanger (LH) and said well casing (2), and subsequently said shear member (41) fails so that said slips (42) move into a position between said member (39) and said well casing (2) to retain said packer (40) in its deformed position.

4. The apparatus as claimed in claim 3 wherein said liner hanger (LH) comprises a plurality of slips (10) which are mounted on a ring (9) which is restrained against motion by a shear member (6).

5. The apparatus as claimed in claim 3, wherein said slips (42) form part of a polished bore receptacle (22).

6. The apparatus as claimed in claim 3 wherein said running tool (100) comprises a liner support unit (LSU) which comprises a body (26), a unit (16) which extends outwardly from said body (26) and engages one of said liner (1) and said liner hanger (LH), and wherein said valve seat (5) is disposed in said liner support unit (LSU) and is releasably attached thereto by a shear member (12).

7. The apparatus as claimed in claim 6 including at least one member (13, 14, 15) which acts between said valve seat (5) and said unit (16) to maintain said unit (16) in said extended position.

8. An apparatus as claimed in claim 6 wherein said liner support unit (LSU) comprises said body (26), a support (25) which is fast with or integral with said body (26), and a ring (29) which is slidably mounted on said body (26), rests on said support (25) and accommodates said unit (16), the arrangement being such that when said unit (16) is in its extended position said body (26) and said support (25) can be moved relative to said ring (29) and the unit (16) accommodated thereby to a secondary release position in which said unit (16) can move radially inwardly.

9. The apparatus as claimed in claim 8 wherein said body (26) is provided with a recess (30) to accommodate said unit (16) when said body (26) is in said secondary release position.

10. The apparatus as claimed in claim 8 wherein said running tool (100) is provided with a lug (24) which rests on said liner hanger (LH), and said liner hanger (LH) is provided with a slot (28) which, when said lug (24) is moved into alignment with said slot (28) allows said running tool (100) to be moved relative to said liner hanger (LH) and said liner support unit (LSU) to be moved to its secondary release position.

* * * * *